US008099827B2

(12) United States Patent
Tagliaferri

(10) Patent No.: US 8,099,827 B2
(45) Date of Patent: Jan. 24, 2012

(54) DEVICE FOR SUCTION OF WASTE AND CONTAMINATING SUBSTANCES FROM THE GROUND

(75) Inventor: Fabrizio Tagliaferri, Trecasali (IT)

(73) Assignee: Dulevo International S.p.A., Sanguinaro di Fontanellato (Parma) (IT)

( * ) Notice: Subject to any disclaimer, the term of this patent is extended or adjusted under 35 U.S.C. 154(b) by 642 days.

(21) Appl. No.: 11/543,401

(22) Filed: Oct. 5, 2006

(65) Prior Publication Data

US 2007/0079456 A1 Apr. 12, 2007

(30) Foreign Application Priority Data

Oct. 7, 2005 (EP) ..... 054225702

(51) Int. Cl.
*A47L 5/14* (2006.01)

(52) U.S. Cl. ..... 15/346; 15/340.3

(58) Field of Classification Search ..... 15/346, 15/345, 347, 354, 340.1, 415.1, 422
See application file for complete search history.

(56) References Cited

U.S. PATENT DOCUMENTS

| | | | | |
|---|---|---|---|---|
| 2,932,845 | A | 4/1960 | Rydberg | |
| 4,457,043 | A * | 7/1984 | Oeberg et al. | 15/346 |
| 4,570,287 | A * | 2/1986 | Kerschner et al. | 15/346 |
| 4,807,327 | A * | 2/1989 | Jajko et al. | 15/346 |
| 5,839,157 | A * | 11/1998 | Strauser et al. | 15/347 |

FOREIGN PATENT DOCUMENTS

| | | |
|---|---|---|
| EP | 0 501 675 A1 | 9/1992 |
| EP | 1 167 631 A1 | 1/2002 |

* cited by examiner

*Primary Examiner* — Dung Van Nguyen
(74) *Attorney, Agent, or Firm* — R. Ruschena Patent Agent, LLC

(57) ABSTRACT

The invention relates to a device for suction of waste and contaminating substances from the ground of the type used in machines for cleaning roads and similar, comprising a suction pipe (2) and a recirculation pipe (3), the device comprising: an inlet aperture (2*a*) of the suction pipe (2*a*) and an outlet aperture (3*a*) of the recirculation pipe (3); the outlet aperture (3*a*) being a slot surrounding the inlet aperture (2*a*) near the ground; the device further comprising a system for adjustment (12) of the distance from the ground consisting of an articulated quadrilateral (13), a fluid dynamic cylinder (14) and at least one castor (15) in contact with the ground.

10 Claims, 3 Drawing Sheets

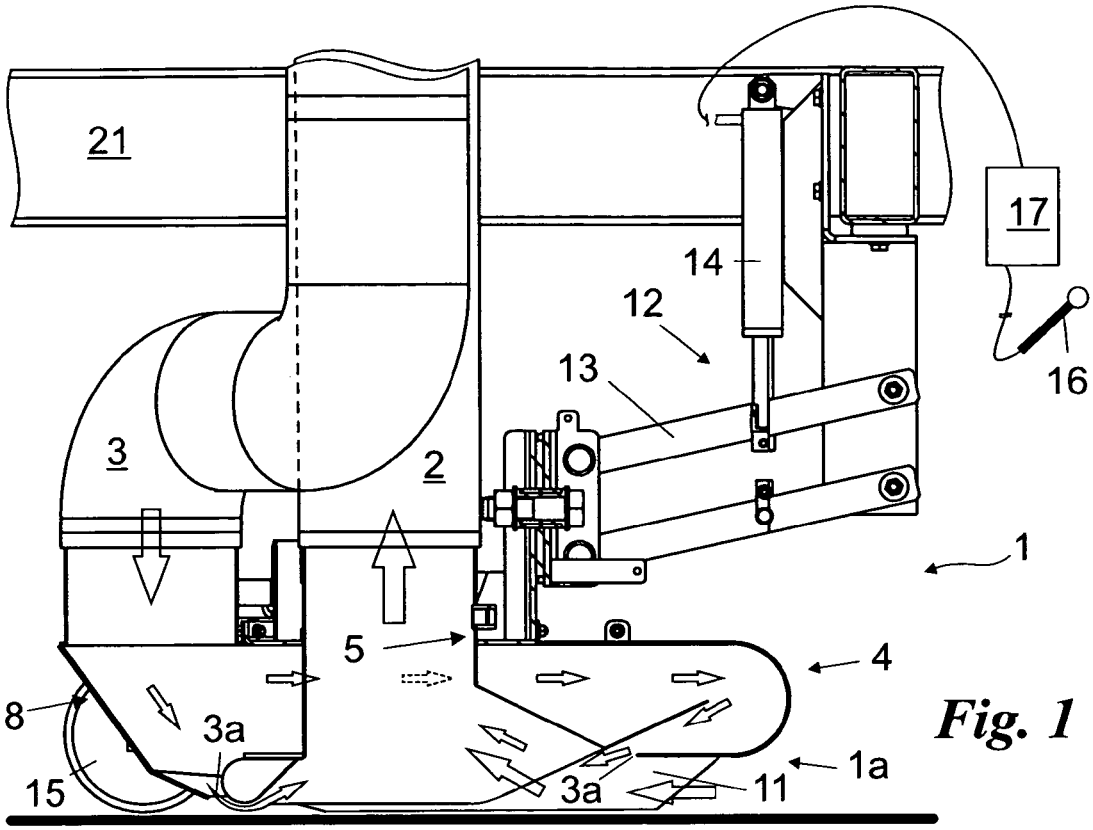
Fig. 1
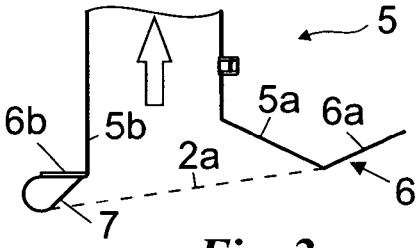
Fig. 2a
Fig. 2b
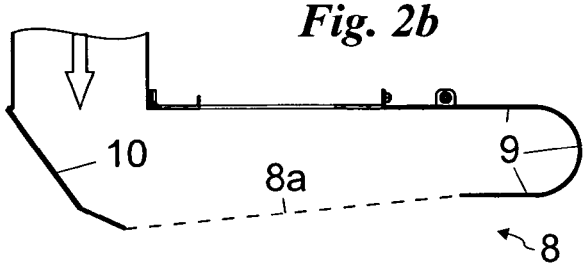
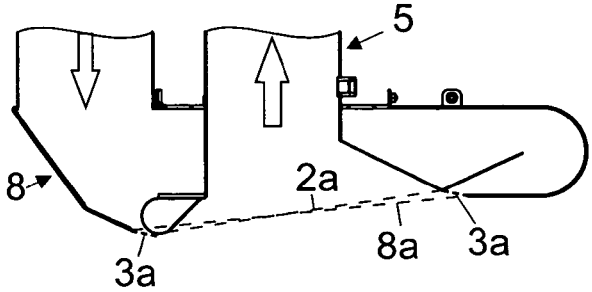
Fig. 2c

DEVICE FOR SUCTION OF WASTE AND CONTAMINATING SUBSTANCES FROM THE GROUND

FIELD OF THE INVENTION

The present invention relates to a device for suction of waste and contaminating substances from the ground, of the type used in road sweepers and similar, comprising a suction pipe and a recirculation pipe.

DESCRIPTION OF THE PRIOR ART

Sweeping and suction machines for cleaning roads and similar have been known for many years.

Said machines use a complex suction system which features a suction inlet located near the ground.

The suction inlet is largely responsible for the suction efficiency of the machine and is therefore of fundamental importance. Over the years, in fact, many different modifications have been made to the end area of the suction pipe.

Of the various improvements made to the suction inlet, the introduction of a laminar air flow which skims the surface of the ground should be highlighted. Said air flow, if appropriately directed, determines a drop in pressure on the surface of the ground due to the known Venturi effect.

The drop in pressure on the surface causes a detachment of the dust and contaminating substances that adhere to the ground and therefore improves the cleaning of the roads and similar.

It has also been ascertained that the use of a device of said type allows a considerable reduction of the energy used for the suction, since the energy (or speed) acquired by the sucking air, instead of being dispersed when the air is discharged to the external environment, is retained since it is sent, via a recycle pipe, to the inlet.

The known technique referred above has some drawbacks.

Very often, the suction inlets of road cleaning machines do not permit the recovery of energy as there are considerable pressure losses along the path and inside the inlet.

Said losses, in particular those at the inlet, are detrimental not only in terms of energy but, above all, they give rise to reflux of air towards the outside, thereby introducing contaminating substances into the environment.

In fact, the air that creates the recycle flow contains dust and contaminating substances sucked in from the ground and only partly decanted along the path. Certainly, it still contains the PM10 type contaminants, the most dangerous to health since they are easily inhaled by humans.

Said dust is therefore dispersed in the environment due to the fact that the flow that skims the ground is not completely captured by the suction pipe.

Furthermore, to obtain the Venturi effect, the surface of the passage of air on the ground must be restricted in order to increase the speed and reduce the pressure. Said restriction produces a pressure loss and therefore a reduction in the air flow. It is obvious that this reduction is felt to an equal extent also in the suction pipe with consequent reduction in speed and therefore a reduced collection of waste in terms of both volume and, above all, weight.

Attempts have already been made to solve the above drawbacks, via various solutions which, in short, are all the result of one single strategy.

The system is produced in such a way as to limit the amount of recirculation of air, dispersing the remaining increased quantity in the environment and causing pollution since it is rich in PM10 type dust, or to convey said additional air together with the primary air to filters that necessarily become larger and therefore occupy more space inside the waste container, reduces the machine operating autonomy, and it is also more expensive.

SUMMARY OF THE INVENTION

In this situation the technical task at the basis of the present invention is to conceive a device for the suction of waste and contaminating substances able to substantially remedy the drawbacks referred to.

In the context of said technical task, an important aim of the invention is to produce a device for the suction of waste and contaminating substances from the ground that uses an air flow which permits optimal lifting of the waste, dust and contaminating substances from the ground with a reduced energy consumption.

A second important aim of the invention is to produce a device for the suction of waste and contaminating substances from the ground which has greatly reduced losses of air and the release of contaminating substances into the environment, also when the road is uneven.

A further important aim of the invention is to conceive a device that maintains a suction air flow to collect waste weighing up to 500 g.

The aims specified are achieved by a device for suction of waste and contaminating substances from the ground, of the type used in road sweepers and similar comprising a suction pipe and a recirculation pipe, said device comprising: an inlet aperture of said suction pipe and an outlet aperture of said recirculation pipe, said outlet aperture consisting substantially of a slot which substantially surrounds said inlet aperture near the ground and comprising a front part and a rear part designed to create opposing air flows; said front part and a said rear part having distances from the ground that differ each other of between 4 cm and 12 cm.

The device permits the detachment of dust and contaminating substances or relatively bulky without dispersion of contaminating substances in the environment.

BRIEF DESCRIPTION OF THE DRAWINGS

Further characteristics and advantages of the invention are better clarified below by the detailed description of a preferred embodiment of the invention, with reference to the attached drawings, in which:

FIG. 1 shows a lateral section of the suction device according to the invention;

FIG. 2*a* schematises a first portion of a device according to the invention;

FIG. 2*b* schematises a second portion of a device according to the invention;

FIG. 2*c* schematises joining of the portions illustrated in FIGS. 2*a* and 2*b;*

DESCRIPTION OF THE PREFERRED EMBODIMENTS

Figure 3:
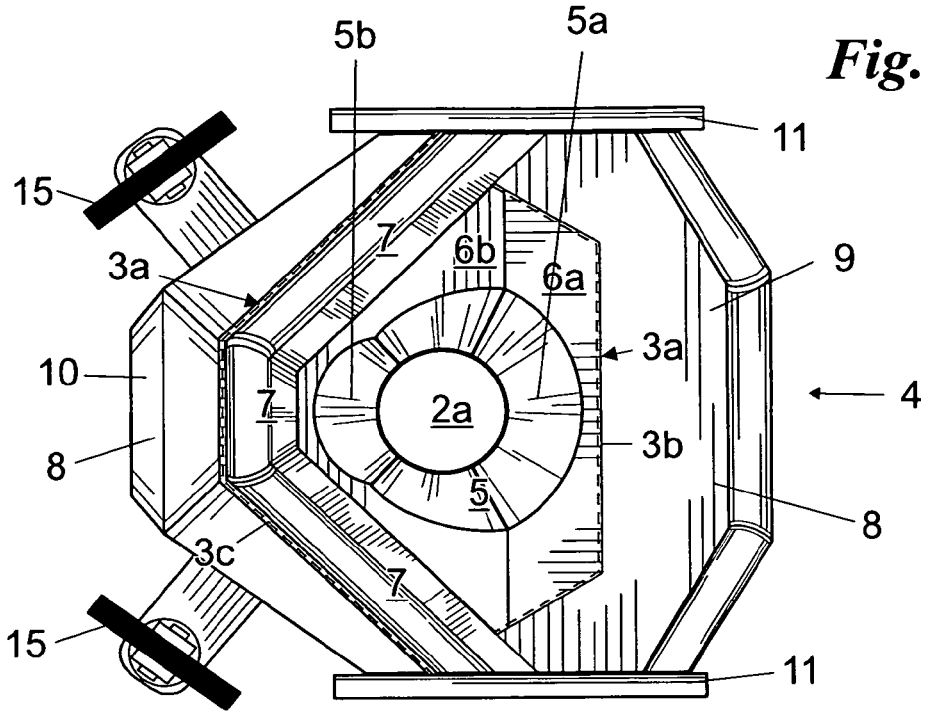
FIG. 3 illustrates the lower view of the device according to the invention.

With reference to the figures referred to, the suction device according to the invention is indicated overall by the number 1.

The device 1 is used in travelling cleaning machines 20 for roads and similar, provided with a suction pipe 2 which sucks air, waste and contaminating substances such as dust and similar, and a recirculation pipe 3, which substantially recirculates the air containing contaminating substances.

Figure 4:
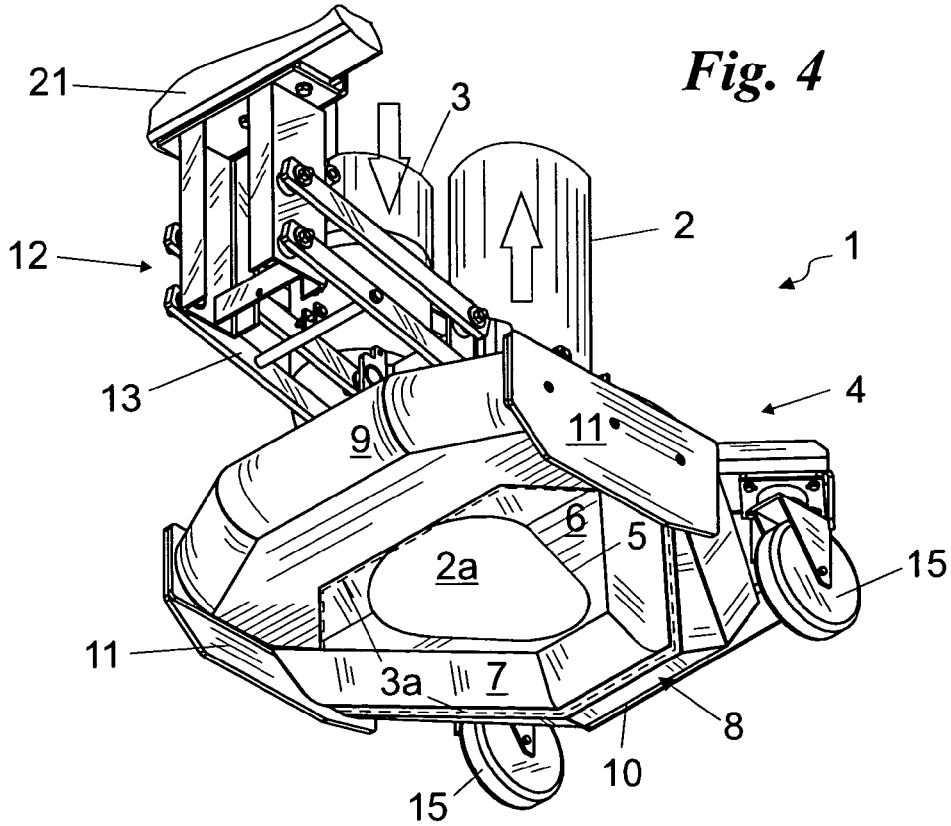
FIG. 4 shows an axonometric view of the device according to the invention.
Figure 5:
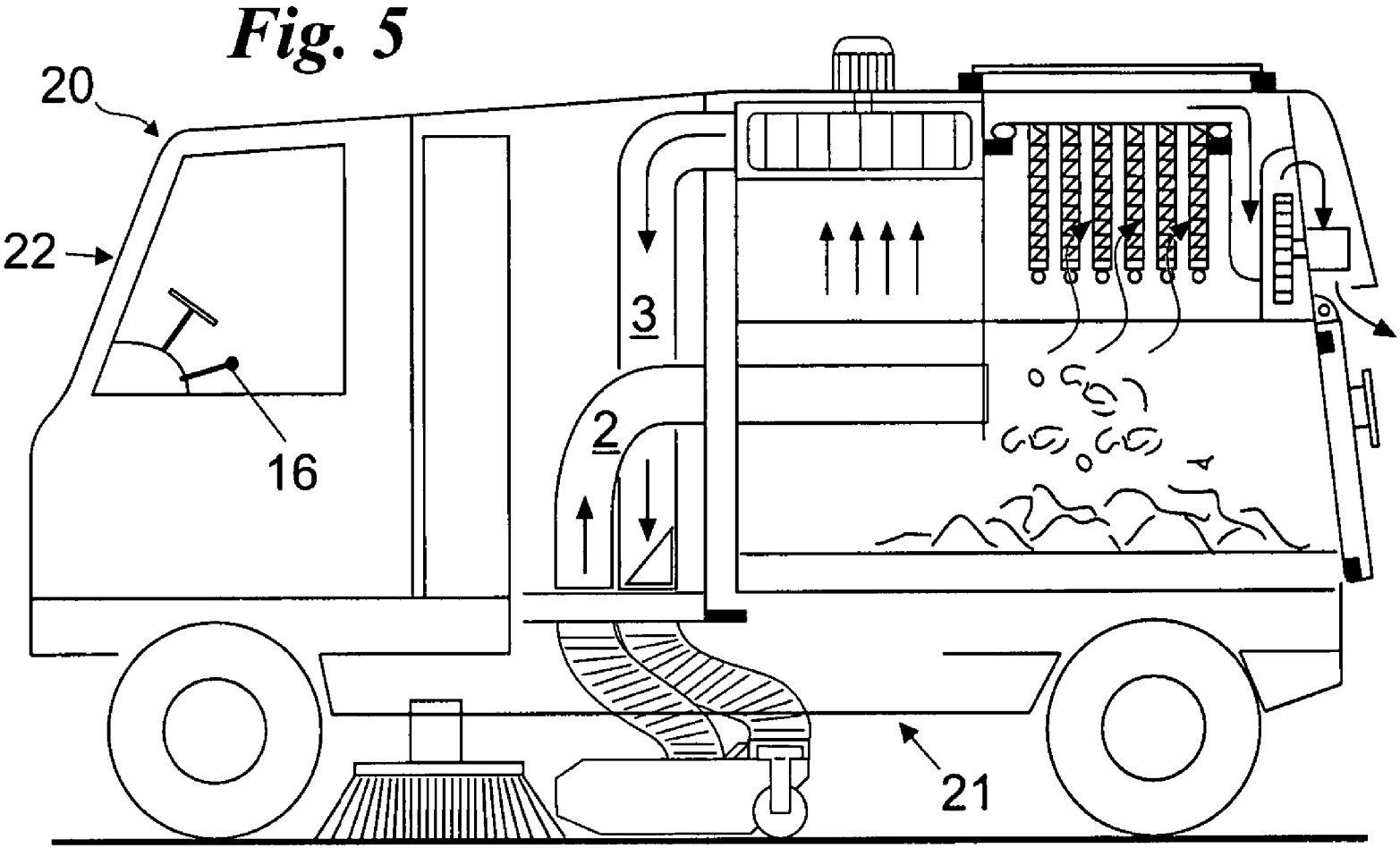
FIG. 5 shows a sweeping and cleaning machine on which a device according to the invention is provided.

The device 1 comprises an inlet aperture 2*a* of the suction pipe 2, and an outlet aperture 3*a* of the recirculation pipe 3, schematically illustrated in FIGS. 3 and 4 by a broken line.

The suction pipe 2 and recirculation pipe 3 lead to a chamber for storage of the waste or similar.

The cleaning machine 20 sucks external waste and air in the direction of forward movement, the inlet 2*a* sucks external air and waste mainly in its front side 1*a*.

The inlet aperture 2*a* and the outlet aperture 3*a* are appropriately defined by a suction structure 4.

The suction structure 4 preferably consists of a central element 5 (FIG. 2*a*) which defines the inlet aperture 2*a* and part of the suction pipe 2, and a peripheral element 8. The central element 5 and the peripheral element 8 are illustrated separately and in section in FIGS. 2*a* and 2*b*.

The central element 5 consists substantially of a circular pipe which expands in diameter near the base of the element 5, or near the inlet aperture 2*a*.

This expansion therefore defines an inlet aperture 2*a* with large surface which improves suction of the waste and reduces the pressure losses. In said regard the central element 5 has preferably a front part 5*a* which expands more than the rear part 5*b* of the central element 5, where the suction of air and waste mainly takes place.

The front part 5*a* also has a height from the ground of approximately 8 cm, in order to suck relatively bulky waste.

The central element 5 furthermore comprises preferably a conveying surface 6, integral with the base of the central element and comprising preferably at least one wing element 7, designed to create an appropriate air flow as specified below, and preferably arranged on three sides. Said wing element 7 has a considerable length to distribute the energy over a large surface.

The wing element 7 extends preferably near the rear part 5*b*, as illustrated in FIGS. 3 and 4.

The conveying surface 6 (FIG. 2*b*) consists preferably of a slanting horizontal flat portion 6*b* at the level of the rear part 5*a* and a slanting flat portion 6*a*, with an opposite slant with respect to the front part 5*a* to which it is connected.

The peripheral element 8 is substantially an expansion and a shaping of the recirculation pipe 3; it therefore includes the outlet aperture 3*a* and connects to said recirculation pipe 3.

The peripheral element 8 almost totally encloses the central element 5. Consequently the central element 5 passes through the upper surface of the peripheral element 8.

Said peripheral element 8 has a lower aperture 8*a* located near the inlet aperture 2*a* (FIG. 2*c*). It substantially surrounds said inlet aperture 2*a* defined by the central element 5.

The outlet aperture 3*a* therefore consists of the portions of the lower aperture 8*a* which are not occupied by the central element 5 (FIG. 1). The outlet aperture 3*a* therefore almost completely surrounds the inlet 2*a*.

Said aperture 3*a* has a very elongated shape and thus reduces the pressure losses optimising the flows and the recirculation energy.

Furthermore, if the aperture 8*a* is very near to the central element 5, the outlet aperture 3*a* is made of slots or thin apertures which generate, according to the known principles of fluid dynamics, high speed air flows.

Lastly, the aperture 8*a* is appropriately located near the ground, so that said air flows create a pressure drop near the ground, where the waste to be collected is located.

Preferably, the peripheral element 8 consists furthermore mainly of a front portion 9 and a rear portion 10.

The front portion 9 substantially surrounds the front part 5*a* of the central element 5, and is at approximately 8 cm from the ground to accommodate the most bulky waste.

Said front portion 9 therefore defines the front part of the outlet aperture 3*a*.

The rear portion 10 comprises the end part of the recycle pipe 3 and therefore envelops and defines the rear part of the outlet aperture 3*a*, positioned appropriately near the wing element 7 and also shaped along three sides, like the wing element 7.

The rear portion 10 is usually at a very limited distance from the ground, in the order of a few millimeters.

Therefore, the front part of the outlet aperture 3*a* and the rear part of the outlet aperture 3*a* have distances from the ground that differ each other of between 4 cm and 12 cm.

Lastly, the peripheral element 8 comprises two lateral partitions 11, which further envelop the sides of the central element 5.

The device 1 comprises a system for adjustment 12 of the distance from the ground. The structure 4 is therefore mobile in a vertical direction with respect to the suction pipes 2 and recycle pipes 3, which are integral with a supporting structure 21, part of the cleaning machine 20.

In order to guarantee the vertical mobility of the structure 4, the end parts of the pipes 2 and 3, integral with the structure 4, have a slightly smaller or slightly larger diameter with respect to the portion of pipes 2 and 3 integral with the supporting structure 21 and engage on the latter.

The adjustment system 12 is preferably automatically adjustable.

The preferred embodiment provides for said system 12 consisting of an articulated quadrilateral 13, or a mechanism consisting of four members, parallel two by two, interconnected by means of hinges.

The articulated quadrilateral 13 has two non-opposed hinges connected to the structure 4 while the remaining two hinges are connected to the supporting structure 21. It maintains the structure 4 in a position parallel to the ground and defines the distance of the structure 4 from the ground.

The articulated quadrilateral 13 is appropriately adjusted by a fluid dynamic cylinder 14, preferably hydraulic, which acts preferably near the end of the articulated quadrilateral 13 integral with the structure 4, so as to obtain a superior sensitivity to the movements of the structure 4.

Furthermore, the system 12 preferably comprises one or more castors 15, integral with the structure 4, which come into contact with the ground and which substantially define the correct distance from the ground of the structure 4.

Two castors 15 are preferably provided and arranged at the two sides of the rear portion 10.

The fluid dynamic cylinder 14 substantially determines the pressure which the castors 15 exert on the ground. It must be possible to vary said pressure according to the type of ground (smooth or uneven, asphalt or concrete) on which the machine 20 is used.

In this regard, means for selection 16 of the pressure which the castors 15 exert on the ground are provided, preferably at the level of the cabin 22 of the machine 20, consisting of a lever, a knob or similar.

Said selection means 16 act on a fluid dynamic circuit 17 or similar, which adjusts the pressure exerted by the fluid dynamic cylinder 14.

Furthermore, the fluid dynamic circuit 17 is preferably able to maintain a constant pressure exerted on the ground. Similar fluid dynamic circuits can be of various types and known in the art.

The machine 20 appropriately comprises two lateral brushes, rotating and of the cup type, or substantially circular and widening towards the base. Said lateral brushes are designed to convey the waste present over a large surface to an accumulation area between the two brushes. Said area must be cleaned by the device 1.

In said regard, the device 1 has a front portion 9 substantially tangent to the brushes. In particular, if the front part has three sides as in the example described, the two lateral sides of said front portion 9 are substantially tangent to the brushes. The brushes furthermore protrude from the machine 20, in order to collect the waste along the curbs of pavements and roads.

In said case, the area cleaned by the device 1 comprises said accumulation area between the lateral brushes, also when the machine is travelling around curbs and similar.

The operation of a suction device 1, structurally described above, is as follows.

At start-up of the cleaning, the device 1 of the cleaning machine 20 is set, automatically or manually, at a correct distance from the ground, and the pressure exerted by the fluid dynamic cylinder 14 is also set by the selection means 16.

The fluid dynamic circuit 17 is therefore activated and acts on the fluid dynamic cylinder 14 which moves the articulated quadrilateral 13.

The castors 15 are then positioned in contact with the ground at a certain pressure selected by the user of the machine 20, by the selection means 16, according to the requirements of the ground to be cleaned or other. Alternatively, the fluid dynamic cylinder 14 can stabilize the device 1 at a height above that one determined by the castors 15.

The pressure on the ground of the device 1, transmitted by means of the castors 15 and detected by said fluid dynamic cylinder 14, is continuously controlled and maintained constant, so that any irregularities in the ground are compensated for by the vertical movement of the device 1.

As the cleaning machine 20 moves forward, the device 1 sucks in waste, contaminating substances and air from the outside via the inlet 2*a*.

The waste is conveyed to the device 1 also by means of the brushes. The device 1 therefore cleans a wide surface area of ground.

In particular, an inflow of waste, contaminating substances and air, is created at the level of the front part 5*a*, which is raised approximately 8 cm from the ground, while the rear part 5*b* is at a very limited distance from the ground, about a few millimeters.

Said flow is conveyed to the inside of the cleaning machine 20, by means of the suction pipe 2, where a first part of the flow is appropriately filtered and partly expelled into the environment. A second part is recirculated via the recirculation pipe 3, and constitutes the recirculation flow.

Said recirculation flow arrives at the rear part 10 of the peripheral element 8 and from here splits into a front flow and a rear flow.

The front flow crosses the internal part of the peripheral element 8, and is expelled via the front part of the outlet 3*a*. A high speed low pressure flow is thus created, which surrounds the front part 5*a* of the central element 5.

The rear flow is conveyed through the upper part of the outlet 3*a*, where a flow forms which surrounds the rear part 5*b* of the central element 5, with a high speed and a low pressure, particularly suitable for the detachment of dust and contaminating substances from the ground or removal of fairly bulky waste.

The invention offers important advantages.

As described, the device 1 creates outgoing air flows at high speed near the ground. Said flows give rise to a surface depression near the ground which permits the detachment of dust and contaminating substances or relatively bulky waste.

In particular, the flow of air coming from the rear portion of the outlet 3*a* is designed particularly to create a depression near the ground and is particularly effective due to the presence of the wing element 7.

Furthermore, the outgoing flow of air completely surrounds the inlet 2*a* of the suction pipe 2.

This solution provides very low pressure losses and therefore high flow rates, without the dispersion of contaminating substances in the environment, allowing bulky, heavy waste to be collected.

A further advantage is provided by the fact that the device 1 is automatically and continuously height-adjustable. Furthermore, the pressure which said device 1 exerts on the ground via the castors 15 can be adjusted.

This allows the device 1 to be always very close to the ground, also when the ground is uneven.

By means of selection means 16, the pressure exerted on the ground by the device 1 can be easily and rapidly adjusted.

Furthermore, the device 1 has a greatly reduced distance from the ground, in the order of a few millimeters. In particular, the side walls 11 and the rear portion 10 are very near the ground, in order to prevent further possible pressure losses. Said reduced distance is maintained constant in the case of rough roads and similar by means of the adjustment system 12.

Last, but not least, it is a further advantage that the device 1 is positioned near the lateral brushes and substantially tangent to the same.

In fact, this arrangement enables the device 1 to completely suck the waste conveyed by the lateral brushes also when travelling around bends and similar. Furthermore, by means of the particular form of the apertures 2*a* and 3*a*, the brushes can be arranged symmetrically with respect to the longitudinal axis of the machine 20. The machine 20 is therefore able to clean in the same way a wide portion of road both right and left sides of the device 1.

What I claim is:

1. A device (1) for suction of waste and contaminating substances from the ground, of type used in road sweepers and similar, comprising a suction pipe (2) and a recirculation pipe (3), said device (1) further comprising:

an inlet aperture (2*a*) of said suction pipe (2) and an outlet aperture (3*a*) of said recirculation pipe (3), said outlet aperture (3*a*) consisting substantially of as lot which substantially surrounds said inlet aperture (2*a*) near the ground and comprising a front part and a rear part designed to create opposing air flows, a wing element (7) bordering said outlet aperture (3*a*) suitable to drive said air flows from said outlet aperture (3*a*) to said inlet aperture (2*a*) so as to create a depression near the ground, said front part and having a greater distance from the ground than said rear part having distances from the ground that differ each other of; and wherein the difference between the distance from said ground of the front part, and the distance of the rear part from the ground is between 4 cm and 12 cm.

2. A device (1) according to claim 1, comprising a central element (5) which constitutes said inlet aperture (2*a*), and a peripheral element (8), including said central element (5) and having an aperture (8*a*) near said central element (5) and said inlet aperture (2*a*), in which said outlet aperture (3*a*) consists of the interaction of said aperture (8*a*) and of said central element (5).

3. A device according to claim 1, including two lateral partitions (11) arranged at the sides of the central element (5).

4. A device according to claim 1, comprising a system for adjustment (12) of the distance from the ground of said outlet aperture (3*a*).

5. A device according to claim 4, wherein said adjustment system (12) consists of an articulated quadrilateral (13), a fluid dynamic cylinder (14) and at least one castor (15) in contact with the ground.

6. A device according to claim 5, wherein said adjustment system (12) comprises means for selection (16) of the pressure exerted by said fluid dynamic cylinder (14).

7. A device according to claim 6, wherein said adjustment system (12) comprises a fluid dynamic circuit (17) designed to maintain a constant pressure exerted on the ground.

8. A machine (20) for cleaning roads and similar designed to suck waste, contaminating substances and air from the ground, comprising: at least one lateral brush of the cup type designed to convey said waste to an accumulation area, a suction pipe (2) and a recirculation pipe (3), a device (1) for sucking waste and contaminating substances from the ground present in said accumulation area and comprising: an inlet aperture (2*a*) of said suction pipe (2) and an outlet aperture (3*a*) of said recirculation pipe (3) wherein said outlet aperture (3*a*) consists substantially of a slot which substantially surrounds said inlet aperture (2*a*) near the ground; said device (1) further comprising a wing element (7) positioned in correspondence of said outlet aperture (3*a*) suitable to drive said air flows from said outlet aperture (3*a*) to said inlet aperture (2*a*) so as to create a depression near the ground; and wherein said front part having a greater distance from the ground than said rear part; and wherein the difference between the distance from the ground of the front part, and the distance of the rear part from the ground is between 4 cm and 12 cm.

9. A cleaning machine (20) according to claim 8, wherein at least one of said lateral brushes is positioned substantially tangent to said device (1).

10. A cleaning machine (20) according to claim 9, wherein at least one of said lateral brushes is positioned substantially tangent to said device (1) and protrudes laterally from the profile of said cleaning machine (20).

* * * * *